US007823339B1

(12) United States Patent
Huber, Jr.

(10) Patent No.: US 7,823,339 B1
(45) Date of Patent: Nov. 2, 2010

(54) WEEP HOLE SCREEN

(76) Inventor: Edmund Burke Huber, Jr., 39 Hunters Point, New Braunfels, TX (US) 78132

( * ) Notice: Subject to any disclaimer, the term of this patent is extended or adjusted under 35 U.S.C. 154(b) by 378 days.

(21) Appl. No.: 10/249,716

(22) Filed: May 2, 2003

(51) Int. Cl.
*E04B 1/72* (2006.01)

(52) U.S. Cl. ..... 52/101; 52/302.3; 52/302.6

(58) Field of Classification Search ..... 52/101, 52/302.1, 302.6, 95, 97, 302.3, 676, 670, 52/634
See application file for complete search history.

(56) References Cited

U.S. PATENT DOCUMENTS

| | | | | | |
|---|---|---|---|---|---|
| 894,504 | A | * | 7/1908 | Jefferis | 52/656.4 |
| 1,701,303 | A | * | 2/1929 | Jones, Jr. | 52/352 |
| 1,701,304 | A | * | 2/1929 | Jones, Jr. | 52/352 |
| 2,005,572 | A | * | 6/1935 | Vass | 52/85 |
| 2,209,741 | A | * | 7/1940 | Sullivan et al. | 210/474 |
| 2,581,521 | A | * | 1/1952 | Davis | 52/169.5 |
| 3,192,849 | A | * | 7/1965 | Massengale | 454/276 |
| 3,220,079 | A | * | 11/1965 | Aggson | 52/302.3 |
| 3,256,654 | A | * | 6/1966 | Pinckney, Jr. | 52/95 |
| 3,269,067 | A | * | 8/1966 | Ellis et al. | 52/216 |
| 3,295,285 | A | * | 1/1967 | Metz | 52/514 |
| 3,331,176 | A | * | 7/1967 | Washam | 52/371 |
| 3,429,084 | A | * | 2/1969 | Brewer | 52/101 |
| 3,436,878 | A | * | 4/1969 | Singer | 52/12 |
| 3,925,946 | A | * | 12/1975 | Balinski et al. | 52/180 |
| 4,282,691 | A | * | 8/1981 | Risdon | 52/101 |
| 4,727,689 | A | * | 3/1988 | Bosler | 52/12 |
| 4,856,237 | A | * | 8/1989 | Wigle | 52/12 |
| 4,877,182 | A | * | 10/1989 | Pugh et al. | 236/44 C |
| 4,885,886 | A | * | 12/1989 | Rosso | 52/404.3 |
| 4,912,888 | A | * | 4/1990 | Martin | 52/12 |
| 4,941,299 | A | * | 7/1990 | Sweers | 52/12 |
| 4,959,932 | A | * | 10/1990 | Pfeifer | 52/12 |
| 5,271,192 | A | * | 12/1993 | Nothum et al. | 52/12 |
| 5,423,154 | A | * | 6/1995 | Maylon et al. | 52/371 |
| 5,438,803 | A | * | 8/1995 | Blizard, Jr. | 52/12 |
| 5,729,931 | A | * | 3/1998 | Wade | 52/12 |
| 5,839,250 | A | * | 11/1998 | Hibler | 52/746.1 |
| 5,976,009 | A | * | 11/1999 | Achen | 454/195 |
| 6,044,594 | A | * | 4/2000 | Desselle | 52/101 |
| 6,176,048 | B1 | * | 1/2001 | Berger | 52/101 |
| 6,244,006 | B1 | * | 6/2001 | Shue et al. | 52/302.1 |
| 6,272,804 | B1 | * | 8/2001 | Leis | 52/302.1 |

(Continued)

FOREIGN PATENT DOCUMENTS

| | | | | |
|---|---|---|---|---|
| JP | 6-129025 | * | 5/1994 | 52/302.1 |

(Continued)

*Primary Examiner*—Phi Dieu Tran A
(74) *Attorney, Agent, or Firm*—Jackson Walker, LLP

(57) ABSTRACT

A weep hole screen and method for installing the same in the exterior wall of a masonry building in order to prevent small animals such as insects and rodents from entering the building through the weep hole. A weep hole screen in accordance with the present invention preferably comprises a rectangular mesh screen with an angle bracket attached to each end. The weep hole screen is sized such that the angle brackets sandwich the bricks that form the weep hole, preferably on the interior faces of the bricks. The interfaces between the weep hole screen and the bricks are preferably sealed with mortar or another suitable sealant. The weep hole screen may be installed easily during original construction of the wall without the need for any mechanical fasteners.

8 Claims, 4 Drawing Sheets

U.S. PATENT DOCUMENTS 6,474,031 B2 * 11/2002 Phillips ..... 52/302.1
6,718,699 B1 * 4/2004 Larson ..... 52/95
6,745,531 B1 * 6/2004 Egan ..... 52/302.1
6,796,100 B1 * 9/2004 Venezia ..... 52/741.1
6,951,077 B1 * 10/2005 Higginbotham ..... 52/12
2002/0124495 A1 * 9/2002 Layne et al. ..... 52/220.1
2003/0230035 A1 * 12/2003 Collins et al. ..... 52/209

FOREIGN PATENT DOCUMENTS

JP 6-180018 * 6/1994 ..... 52/302.1

* cited by examiner

WEEP HOLE SCREEN

BACKGROUND OF INVENTION

1. Field of the Invention

This invention relates to an improved weep hole screen and method of installing the same for covering weep holes in masonry buildings.

2. Description of the Related Art

In masonry buildings, the exterior walls are usually provided with a number of weep holes to allow adequate ventilation of the space between the exterior walls and the interior walls. Weep holes are typically formed during exterior wall construction by simply not placing mortar in the gap between two adjacent bricks. Although weep holes are useful for providing ventilation, they also present a problem of intrusion of insects and rodents into the walls.

In view of that problem, a number of types of weep hole screens have been developed over the years. However, each of the prior weep hole screens has significant drawbacks. Most of the existing weep hole screens are designed for installation after the construction of the walls and therefore involve some attempt to fasten the weep hole screens on the exterior of the walls. Examples of such weep hole screens include U.S. Pat. No. 6,360,493 to Torres III, U.S. Pat. No. 6,176,048 to Berger, U.S. Pat. No. 6,044,594 to Desselle, and U.S. Pat. No. 5,203,795 to Balamut et al., each of which is incorporated herein by reference. Such designs that involve the use of mechanical fasteners are problematic because of the difficulties of using mechanical fasteners in masonry. Specifically, mechanical fasteners do not readily penetrate and hold in masonry but tend to grind to powder or chip away the masonry. Additionally, some of the existing designs involve movable parts, which unnecessarily increases the level of complexity for manufacture and installation and increases the cost. Because of those drawbacks, it would be a significant advancement in the art to provide a weep hole screen that requires no mechanical fasteners, has no moving parts, is simple and inexpensive to manufacture and install.

SUMMARY OF INVENTION

The present invention is directed to an improved weep hole screen and method for installing the same in the exterior wall of a masonry building in order to prevent small animals such as insects and rodents from entering the building through the weep hole. A weep hole screen in accordance with the present invention preferably comprises a rectangular mesh screen with an angle bracket attached to each end. The weep hole screen is sized such that the angle brackets sandwich the bricks that form the weep hole on the interior faces of the bricks. The interfaces between the weep hole screen and the bricks are preferably sealed with mortar or another suitable sealant. The weep hole screen may be installed easily during original construction of the wall. Such a weep hole screen is advantageous because it is simple and inexpensive to manufacture and install. By installing the present weep hole screen during original construction, the weep hole screen is cemented firmly in place without the need for mechanical fasteners. Additionally, the present weep hole screen is located on the interior face of the brick wall, so it is not readily visible from the exterior and is out of the way and not likely to get knocked off by activities occurring on the exterior of the building, such as lawn care and building maintenance.

DETAILED DESCRIPTION

Figure 1:
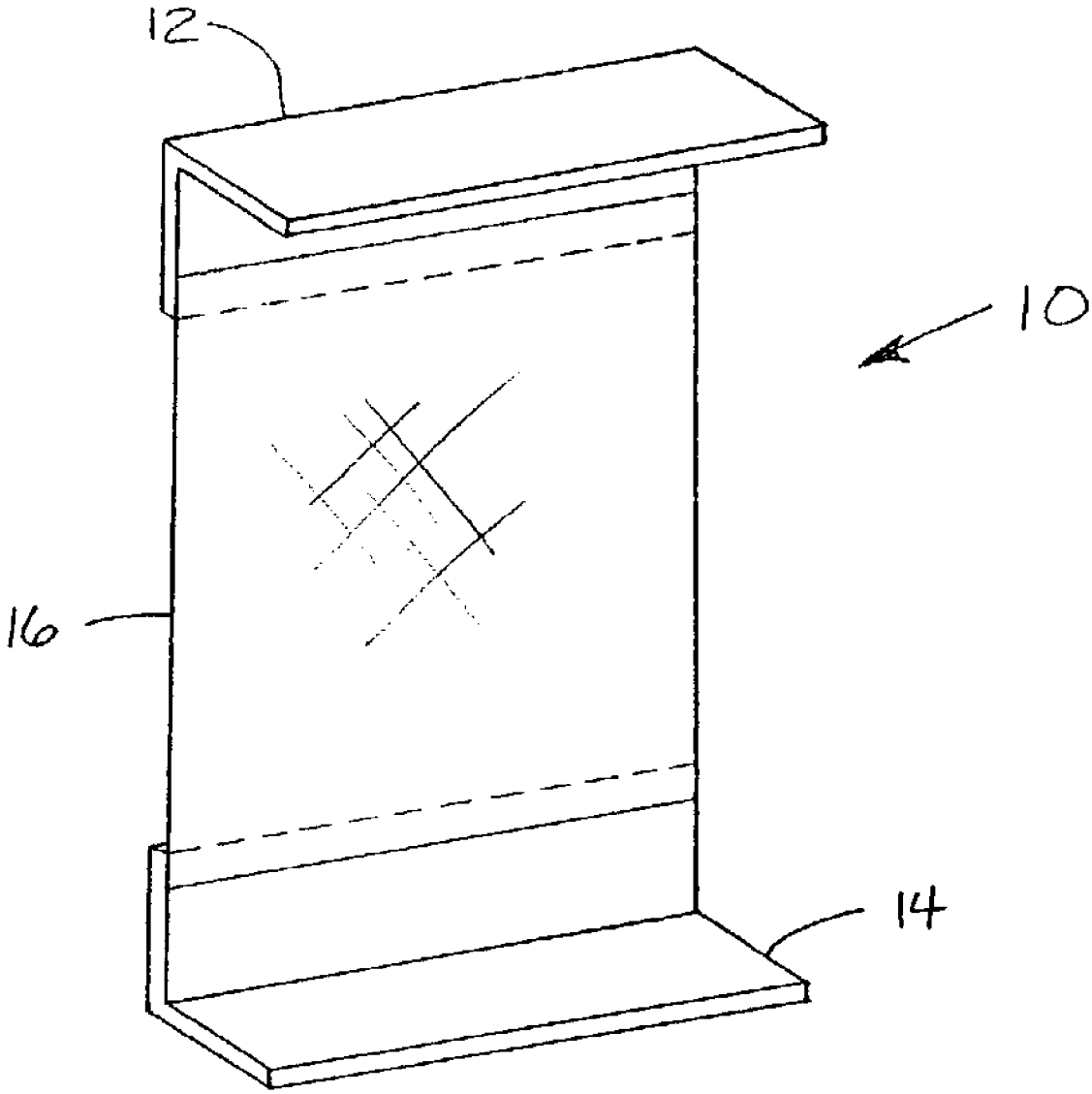
FIG. 1 is a perspective view of a weep hole screen in accordance with the present invention.

Referring to FIG. 1, a weep hole screen 10 in accordance with the present invention comprises a mesh screen 16 which is attached to angle brackets 12 and 14 at either end. The attachment of screen 16 to angle brackets 12 and 14 may be by any suitable means, such as by welding, adhesives, or mechanical fasteners. Screen 16 preferably has holes that are small enough to prevent insects and rodents from passing through it yet large enough to allow air and moisture to pass through. Angle brackets 12 and 14 and screen 16 may be made of any suitable material, such as metal, plastic, or nylon.

Figure 2:
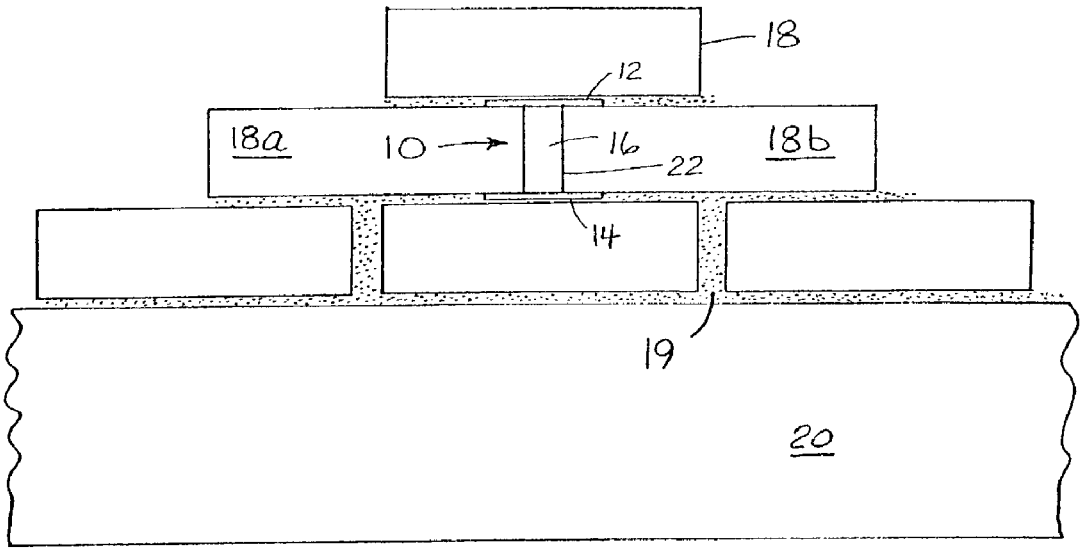
FIG. 2 is a front elevation view of a portion of a brick wall having a weep hole with a weep hole screen installed in accordance with the present invention.

As seen in FIG. 2, weep hole screen 10 is sized such that angle brackets 12 and 14 are able to snugly sandwich a pair of adjacent bricks 18*a* and 18*b* having a weep hole 22 therebetween. Bricks 18 and mortar 19 are arranged to form a wall atop foundation 20 as is known in the art. Weep hole screen 10 is installed during original construction of the wall. Although weep hole screen 10 may be installed on the exterior of the wall, weep hole screen 10 is preferably installed on the interior of the wall, as best shown in FIG. 3.

Figure 3:
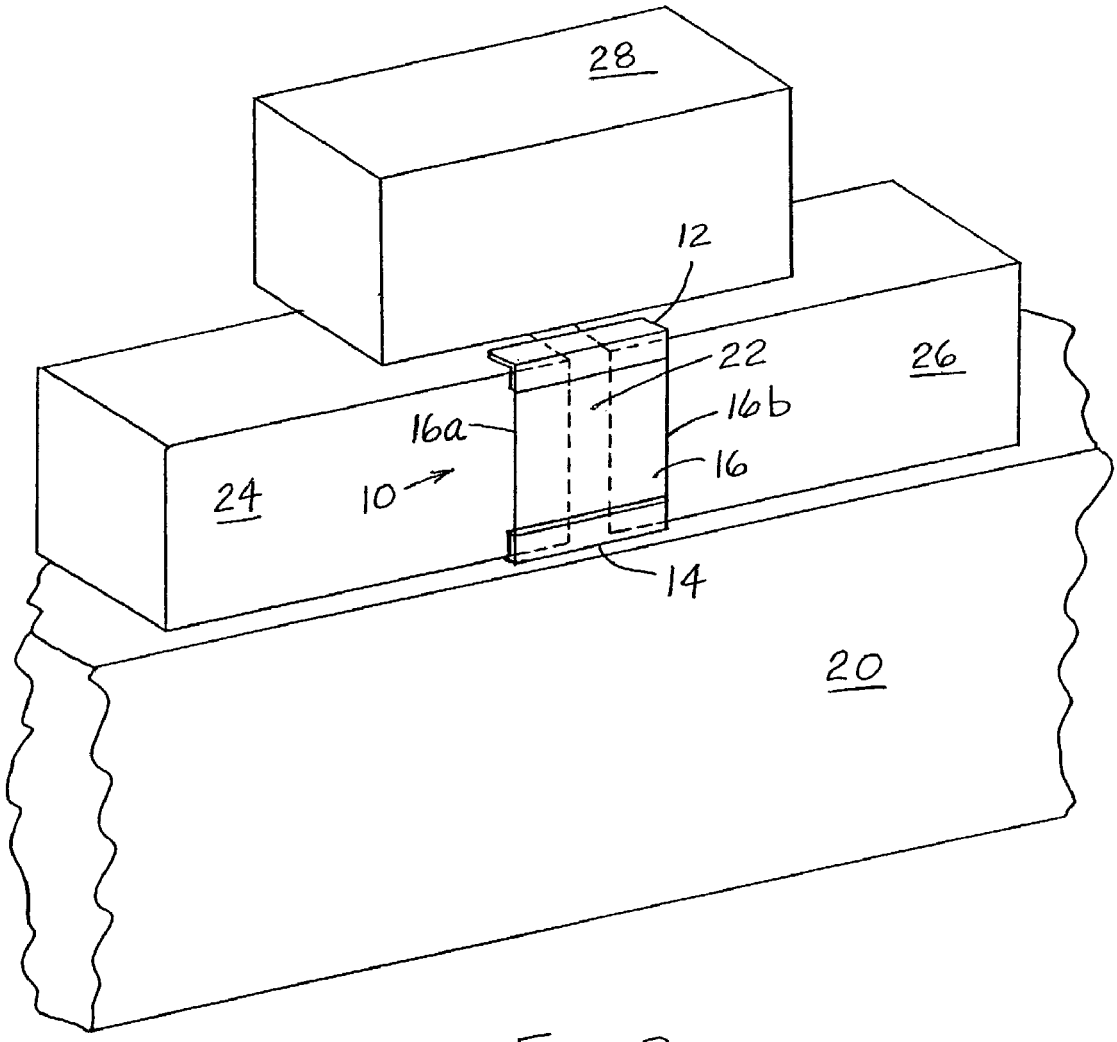
FIG. 3 is a rear perspective view of a portion of a brick wall having a weep hole with a weep hole screen installed in accordance with the present invention.

FIG. 3 is a view from the inside of a portion of a brick wall comprising bricks 24, 26, and 28 on top of foundation 20. For the sake of clarity, no mortar is shown in FIG. 3. A weep hole 22 is formed by the absence of mortar between bricks 24 and 26. Angle brackets 12 and 14 of weep hole screen 10 sandwich bricks 24 and 26 in the vicinity of weep hole 22 such that screen 16 covers weep hole 22. Mortar (not shown) between foundation 20 and bricks 24, 26, 28 serves to cement weep hole screen 10 firmly in place and to seal the interfaces between angle brackets 12, 14 and bricks 24, 26. Mortar or another suitable sealant (not shown), such as silicone or adhesive, may also be used to seal the edges 16*a* and 16*b* of screen 16 to the back sides of bricks 24 and 26, respectively. In this manner, weep hole screen 10 allows the interior of the wall to breathe while preventing insects or rodents from entering into the interior of the wall through the weep hole 22. Those skilled in the art will appreciate that weep hole screen 10 provides a significant advantage over currently available weep hole screens in that weep hole screen 10 has no moving parts, and no mechanical fasteners are required for installation. Weep hole screen 10 is simple and inexpensive to manufacture and install and thus provides a much more efficient solution to the problem of insect and rodent entry than presently available weep hole screens which are installed on the exterior after a wall is constructed.

Figure 4:
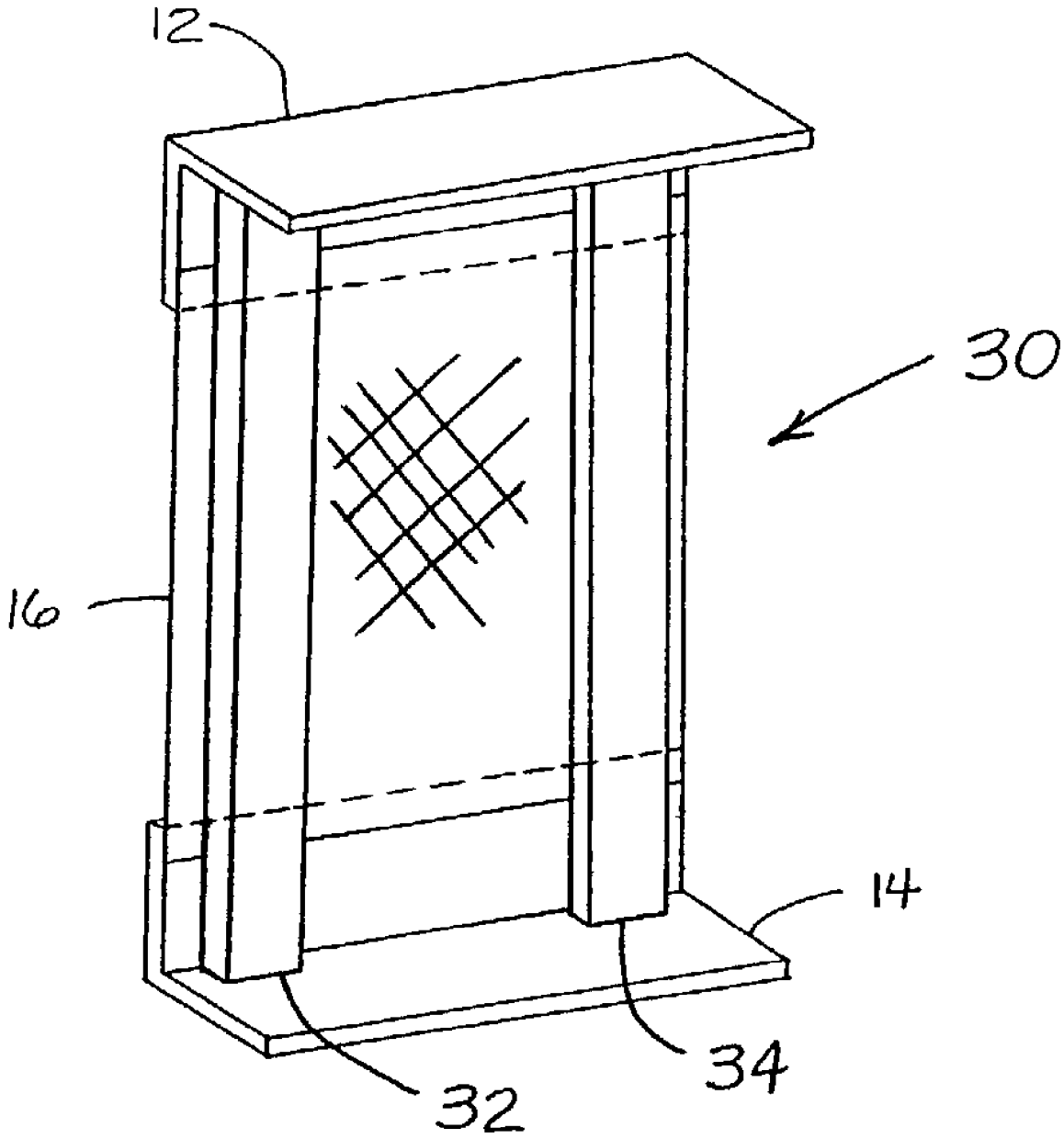
FIG. 4 is a perspective view of an alternative weep hole screen in accordance with the present invention.

Referring to FIG. 4, an alternative weep hole screen 30 is the same as weep hole screen 10 described above except that peel-off adhesive strips 32, 34 are installed along the front sides of screen 16 between angle brackets 12, 14. Peel-off adhesive strips 32, 34, which are preferably of the type having a protective layer (not shown) that is peeled off to expose the adhesive prior to installation, enhance the seal between screen 16 and the backs of the bricks that are sandwiched between angle brackets 12, 14 when weep hole screen 30 is installed. As an alternative to peel-off adhesive strips 32, 34, other suitable sealants may be used, such as silicone, putty, or epoxy.

Referring again to FIG. 3, weep hole screen 10 is preferably installed by placing a first amount of mortar (not shown) on foundation 20, which serves as a mounting surface. Bricks 24 and 26 are placed upon the first amount of mortar in spaced relation to one another so as to form a weep hole 22. Weep hole screen 10 is positioned about bricks 24 and 26 such that brackets 12 and 14 sandwich bricks 24 and 26 about the weep hole 22 and mesh screen 16 abuts the rear surfaces of bricks 24 and 26. Edges 16*a* and 16*b* of mesh screen 16 are sealed to the rear surfaces of bricks 24 and 26, preferably with mortar. Other suitable sealant, such as silicone, putty, or epoxy, could be used instead of mortar, but mortar is preferred because it is readily available for brick building construction as a matter of course. Brick 28 is then installed with mortar on top of bricks 24 and 26. Angle bracket 12 is thus cemented firmly in place in the mortar between bricks 24, 26, 28, and angle bracket 14 is cemented firmly in place in the mortar between bricks 24, 26 and foundation 20. In addition to holding weep hole screen 10 in place, the mortar also seals the interfaces between weep hole screen 10 and the bricks 24, 26, 28 and foundation 20 and thereby prevents insects and rodents from entering the building through the weep hole 22. Weep hole screen 30 of FIG. 4 is preferably installed in like manner as weep hole screen 10 as described above, except that the protective layer is peeled off of each of the adhesive strips 32 and 34 before weep hole screen 30 is positioned about the bricks 24, 26. Adhesive strips 32 and 34 thereby seal the interfaces between mesh screen 16 and bricks 24, 26.

Although the foregoing specific details describe a preferred embodiment of this invention, persons reasonably skilled in the art will recognize that various changes may be made in the details of this invention without departing from the spirit and scope of the invention as defined in the appended claims. Therefore, it should be understood that this invention is not to be limited to the specific details shown and described herein.

The invention claimed is:

1. A frameless weep hole screen assembly comprising:

a first brick;

a second brick;

the first and second bricks adjacent one another in spaced apart relation, the space defining a weep hole;

wherein each of the first and second bricks has an upper surface, a lower surface, a rear surface, a front surface, a first side wall, and a second side wall;

a mesh screen;

a first angle bracket;

a second angle bracket spaced apart from and not connected to said first angle bracket; and wherein the mesh screen is attached to said first and second angle brackets;

wherein said first and second angle brackets are adapted to be positionable about the upper and lower surfaces of the first and second bricks such that said mesh screen substantially covers the weep hole;

wherein said first angle bracket comprises a first flange positionable adjacent the upper surface of each of the bricks, and a second flange positionable adjacent the rear surface of each of the bricks;

said second angle bracket comprises a third flange positionable adjacent the lower surface of each of the bricks;

and a fourth flange positionable adjacent the rear surface of each of the bricks;

said mesh screen being attached to said second and fourth flanges.

2. The weep hole screen assembly of claim 1 wherein, when said first and second angle brackets are positioned about the bricks, said first and second flanges are substantially perpendicular, and said third and fourth flanges are substantially perpendicular.

3. The weep hole screen assembly of claim 2 wherein:

each of said second and fourth flanges has an interior surface facing toward the bricks and an exterior surface facing away from the bricks, and said mesh screen is attached to said interior surface of each of said second and fourth flanges.

4. The weep hole screen assembly of claim 1 further comprising at least one peel-off adhesive strip attached to said mesh screen.

5. A frameless weep hole screen assembly for covering a weep hole consisting essentially of:

a first brick;

a second brick, the first and second bricks adjacent one another in spaced apart relation, the space defining a weep hole, wherein each of the first and second bricks has an upper surface, a lower surface, a rear surface, a front surface, a first side wall, and a second side wall;

a first bi-ended angle bracket open at each of its two ends;

a second bi-ended angle bracket open with each of its two ends, said second angle bracket being spaced apart from said first angle bracket; and a mesh screen attached to said first and second angle brackets wherein said first bi-ended angle bracket comprises a first flange positionable adjacent the upper surface of each of the bricks, and a second flange positionable adjacent the rear surface of each of the bricks;

said second bi-ended angle bracket comprises a third flange positionable adjacent the lower surface of each of the bricks;

and a fourth flange positionable adjacent the rear surface of each of the bricks;

said mesh screen being attached to said second fourth flanges;

wherein said first and second angle brackets are positionable about the bricks such that said mesh screen covers the weep hole.

6. A frameless weep hole screen assembly, said weep hole screen comprising:

a first brick;

a second brick;

the first and second bricks adjacent one another in spaced apart relation, the space defining a weep hole;

wherein each of the first and second bricks has an upper surface, a lower surface, a rear surface, a front surface, a first side wall, and a second side wall;

a first angle bracket having a first flange positionable adjacent the upper surface of each of the bricks, and a second flange positionable adjacent the rear surface of each of the bricks; said first and second flanges being substantially perpendicular;

a second angle bracket spaced apart from and unconnected to said first angle bracket, said second angle bracket having a third flange positionable adjacent the lower surface of each of the bricks, and a fourth flange positionable adjacent the rear surface of each of the bricks;

said third and fourth flanges being substantially perpendicular; and a mesh screen attached to said second and fourth flanges, said mesh screen being adaptable for covering the weep hole adjacent the rear surfaces of the bricks.

7. The weep hole screen assembly of claim 6 further comprising means for sealing said mesh screen to each of the bricks.

8. The weep hole screen assembly, of claim 7 wherein said means for sealing comprises at least one peel-off adhesive strip.

* * * * *